United States Patent [19]

Collier

[11] Patent Number: 4,485,519

[45] Date of Patent: Dec. 4, 1984

[54] OZONE CLEANING SYSTEM

[75] Inventor: David S. Collier, Mississauga, Canada

[73] Assignee: Carpet Clinic Ltd., Toronto, Canada

[21] Appl. No.: 381,380

[22] Filed: May 24, 1982

[51] Int. Cl.[3] ..... A47L 5/34

[52] U.S. Cl. ..... 15/359; 15/339; 15/385; 55/279

[58] Field of Search ..... 15/320, 321, 322, 345, 15/346, 385, 339, 359; 55/279; 422/5; 68/222; 38/69

[56] References Cited

U.S. PATENT DOCUMENTS

| | | | |
|---|---|---|---|
| 2,242,163 | 5/1941 | Bargeboer | 55/279 |
| 2,590,152 | 3/1952 | Buckey | 15/339 |
| 2,648,396 | 8/1953 | Kirby | 15/339 |
| 2,681,467 | 6/1954 | Guyer | 15/339 |
| 3,296,777 | 1/1967 | Jackson et al. | 55/279 |
| 3,686,707 | 8/1972 | Hughes et al. | 15/320 |
| 3,849,823 | 11/1974 | Adamson et al. | 15/320 |
| 4,000,538 | 1/1977 | Tissier | 15/385 |
| 4,168,562 | 9/1979 | Maasberg | 15/322 |
| 4,327,459 | 5/1982 | Gilbert | 15/321 |
| 4,339,840 | 7/1982 | Monson | 15/320 |

FOREIGN PATENT DOCUMENTS

| | | | |
|---|---|---|---|
| 1286189 | 1/1962 | France | 15/385 |

*Primary Examiner*—Philip R. Coe
*Assistant Examiner*—Michael Knick

[57] ABSTRACT

The present invention relates to a system for ozone cleaning of surfaces on carpets, furniture, drapery and the like. The system comprises an ozone producing unit and a portable cleaning unit having a cleaning head. The ozone produced in the system is directed past the cleaning head onto the surface to be cleaned while the cleaning head is in operation for maximizing the cleaning effects of the system.

9 Claims, 7 Drawing Figures

FIG.1.
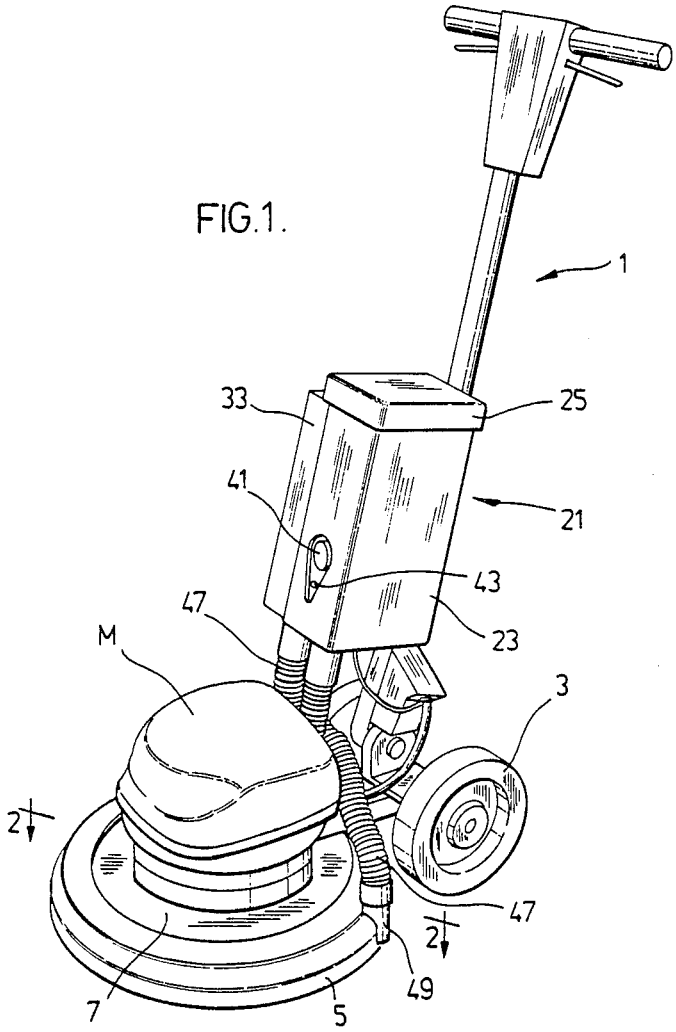
FIG. 2a.
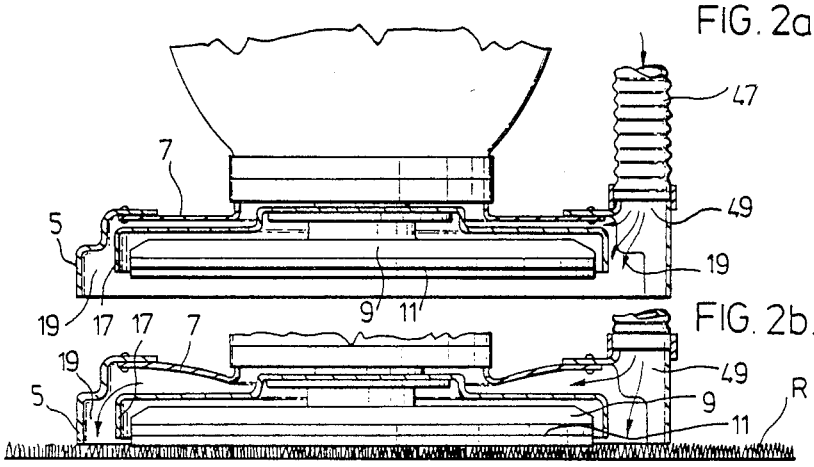
FIG. 2b.

OZONE CLEANING SYSTEM

FIELD OF THE INVENTION

The present invention relates to a system for ozone cleaning of contaminated surfaces in which the ozone is directed onto the surface by means of a portable cleaning unit.

BACKGROUND OF THE INVENTION

It has been found that ozone is an extremely effective cleaning agent particularly as a deoderizer in odour contaminated areas. In the past ozone has been used in burned buildings to eliminate the smell of smoke by sealing off the building and then pumping in ozone. Ozone is also being used instead of chlorine or other chemicals to fight odour causing bacteris in swimming pools. In addition, Ozone is used as a deoderizer in sewage treatment plants.

It has been known in the past to use ozone in association with vacuum cleaning where the vacuumed material drawn into the vacuum bag is subjected to ozone to prevent the build of mould and the like in the bag and to deodorize the air flowing from the motor through the bag. U.S. Pat. No. 2,242,163 issued May 13, 1941 to A. Bargeboer shows such an arrangement. However, according to the Bargeboer structure the vacuumed surface itself is not subjected to the ozone which is produced only in the filter area of the vacuum.

SUMMARY OF THE PRESENT INVENTION

The present invention provides an ozone cleaning system in which surfaces to be cleaned on carpets, furniture, drapery and the like are directly subjected to ozone. The system comprises an ozone producing unit and a portable cleaning unit having a cleaning head with at least one ozone outlet at the cleaning head. An ozone passage is provided from the ozone producing unit to the at least one ozone outlet and a blower is used for blowing the ozone along the ozone passage. The ozone producing unit is adapted to prevent escape of ozone therefrom other than at the ozone passage and the at least one ozone outlet is adapted to direct the ozone under pressure from the blower past the cleaning head at the surface for maximizing the cleaning thereof.

According to the present invention, essentially all the ozone produced is put to effective use and since it is blown under pressure there is great penetration of the ozone into the contaminated surface from which the ozone slowly dissipates while it is deodorizing.

BRIEF DISCUSSION OF THE DRAWINGS

The above as well as other advantages and features of the present invention will be described in greater detail according to the preferred embodiments of the present invention in which:

FIG. 1 is a perspective view of an ozone rug cleaning device according to one preferred embodiment of the present invention;

FIG. 2A is a section taken along the lines 2—2 of FIG. 1;

FIG. 2B is a view similar to FIG. 2A showing the rug cleaning device of FIG. 1 in contact with the rug surface;

DETAILED DESCRIPTION ACCORDING TO THE PREFERRED EMBODIMENTS OF THE PRESENT INVENTION

In FIG. 1 an ozone cleaning unit generally indicated at 1 is used for cleaning rugs, carpets and other similar types of floor surfaces. The unit which is hand operated through a handle mechanism at its upper end is provided with a pair of wheels 3 which are elevated relative to the cleaning head and which are only used for transport by tipping the unit onto the wheels. Supported above the wheels is a motor M for operating the cleaning head of the unit. A combination ozone producing and blowing unit generally indicated at 21 is provided on the handle of the unit so that it is carried with the cleaning unit while in operation.

Figure 3:
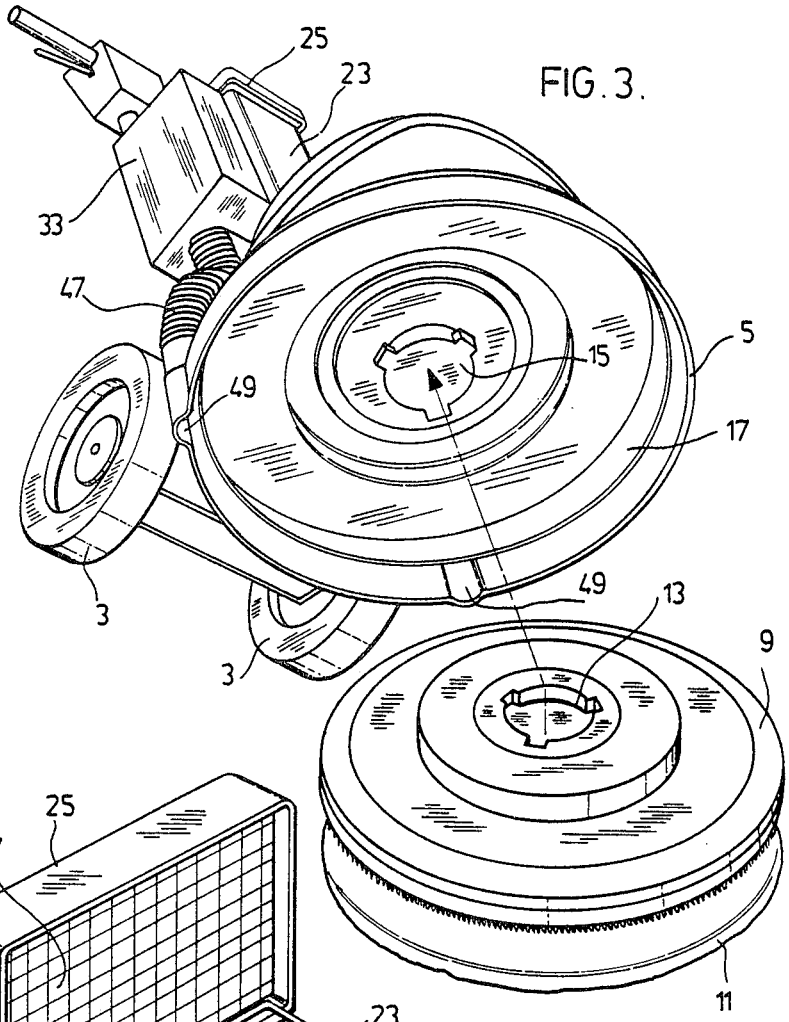
FIG. 3 is a partially exploded bottom perspective view of the rug cleaner shown in FIG. 1.
Figure 4:
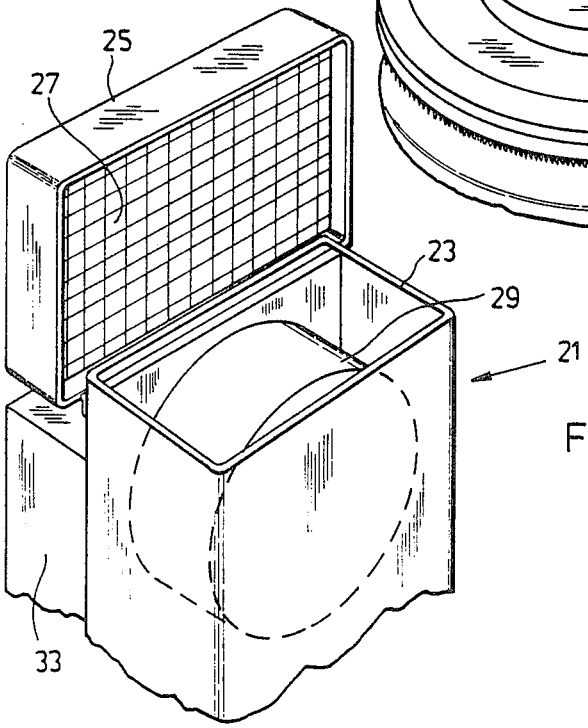
FIG. 4 is a perspective view looking down on the filter area of the ozone unit of FIG. 1.

The cleaning head itself is best shown in FIGS. 2A, 2B and 3. It includes a rotatable support plate 9 with a fabric pad 11 held to the bottom of the plate. The plate is provided at its upper end with an opening 13 into which connector 15 from the unit motor is adapted to lock for rotation of the plate and cleaning pad. For operation of the cleaning head the pad is soaked in a detergent and rotates on the rug R shown in FIG. 2B to clean contaminants from the rug.

A frame portion 17 provided at the periphery of the cleaning head with an exterior floating shroud 5 surrounding both the head frame and the cleaning head. Shroud 5 is secured to the cleaning unit through a flexible membrane 7 which allows up and down movement of the shroud in accordance with the surface level on which the unit is being used so that the shroud follows the contour of the surface over which it is travelling to substantially eliminate the outward escape of Ozone.

Figure 5:
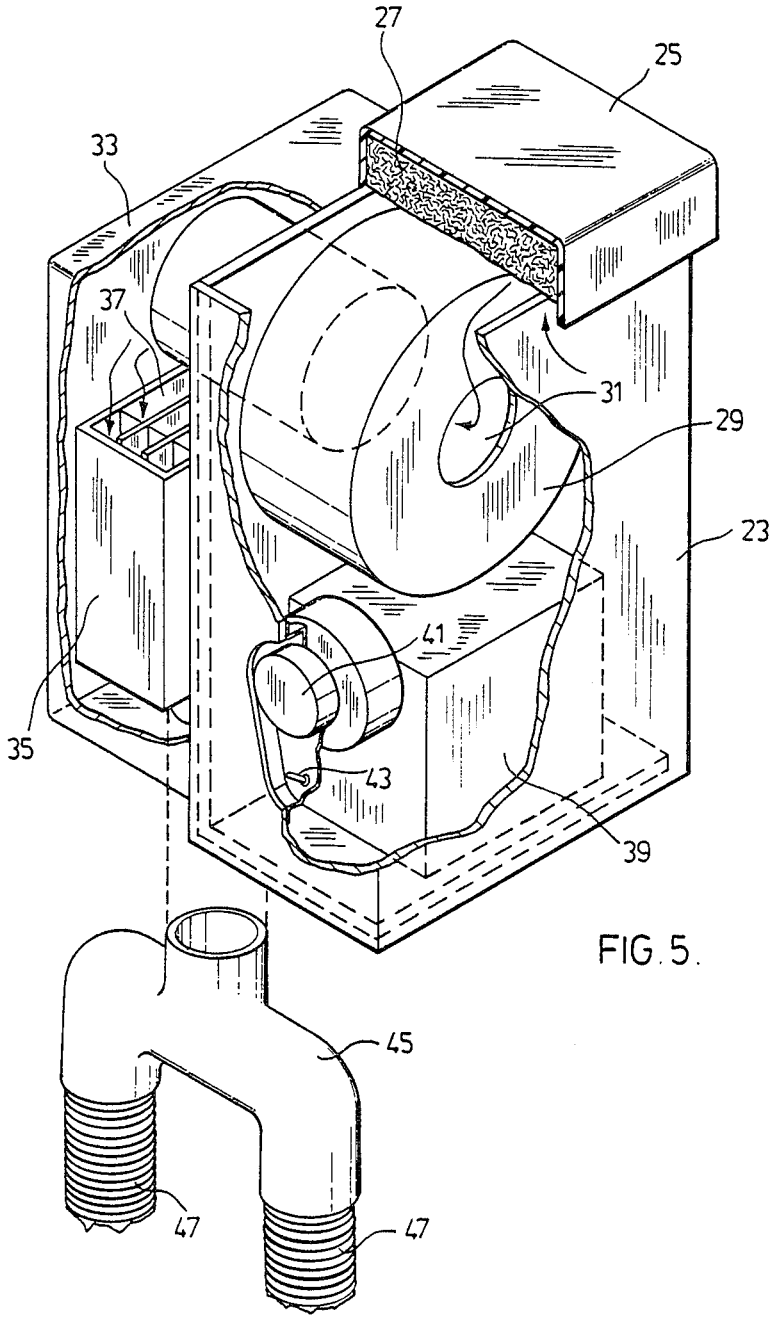
FIG. 5 is a partially sectioned perspective view showing in greater detail the ozone producing unit of the rug cleaner of FIG. 1.

A pair of flexible tubes 47 connect the ozone producing unit to shroud 5. These tubes as best shown in FIG. 5 extend from a manifold 45 fitted directly to the bottom of an ozone box 33 and extend to ozone outlets 49 to either side of shroud 5. These ozone outlets are set up to direct the ozone downwardly into the rug surface and around a channel 19 between shroud 5 and cleaning head frame 17 as best shown in FIG. 2B.

The combination unit shown in FIG. 5 includes both an ozone producing side housed in box 33 and a motor side housed in box 23 for blowing the ozone through tubes 47 to the cleaning head of the unit.

A grid network 35 is located in box 33. This network comprises a plurality of electrical grids separated by mica inserts to produce a corona at the electrical grid. The corona in turn produces ozone from the air surrounding the electrical grid. The level of the corona and the amount of ozone produced which are directly proportionate to one another are controlled through a rheostat 41 provided on transformer 39 for adjusting the electrical intensity at the grid. A switch 43 is also provided at the transformer for on/off control of the transformer and electrical grid.

The motor 29 within the combination unit produces a vacuum within box 23 such that air is drawn in from the top 25 of the box past filter 27 and through the central opening 31 of the motor. The air drawn in from the vacuum side of the motor is blown into ozone box 33 and through the spaces 37 of grid network 35 where it picks up the produced ozone. Box 33 is sealed other than at the opening through the blower, where there is air pressure, and at the opening into which manifold 45 is fitted so that essentially all of the ozone produced is blown down into the manifold through tubes 47 extending to ozone outlets 49 at shroud 5.

When the unit is in operation it can be run either as a standard floor cleaner without ozone or it can be run as a combination unit in which both the cleaning head and the ozone producing unit are actuated to clean the surface over which the unit passes. It can also be run strictly using ozone and no cleaning head. According to the latter two modes of operation essentially all of the ozone produced is directed to shroud 5 which acts as a closure to prevent the escape of ozone other than downwardly into the rug. Accordingly maximum use of the produced ozone is achieved through its concentration by means of the shroud 5.

Shroud 5 is as described above connected to the cleaning unit through the flexible membrane 7 which enables the shroud to float to the rug surface. This is particularly advantageous when the rug has a relatively thick soft pile because regardless of the pile thickness the shroud sits at the surface level of the rug as shown in FIG. 2B allowing easy movement of the entire cleaning unit across the rug surface. It should be noted that tubes 47 are also flexible to accommodate the flotation of shroud 5 while maintaining a leak-free connection between the ozone producing unit and the shroud.

This floating shroud principle provided through the use of a flexible membrane or diaphragm may also be used on other types of floor and rug cleaning units in which it is desirable to have automatic height adjustment of the shroud. For example, if the unit is used to dispense cleaning fluids other than ozone, the flow of these other cleaning fluids should also be controlled beneath the shroud. However, at the same time the shroud should be allowed to float to the surface level over which the unit is being directed to enable its smooth travel.

The amount of ozone produced by cleaning unit 1 is adjusted according to the degree of cleaning and decontamination required. For example, the unit may be run at a production of 200 milligrams/hour of ozone at a flow rate of about 50 cfm directed into the rug. This flow rate which is controlled in its direction of travel downwardly into the rug, is safe to the health of the operator while at the same time providing good decontamination effects due to the concentration into the rug pile.

Figure 6:
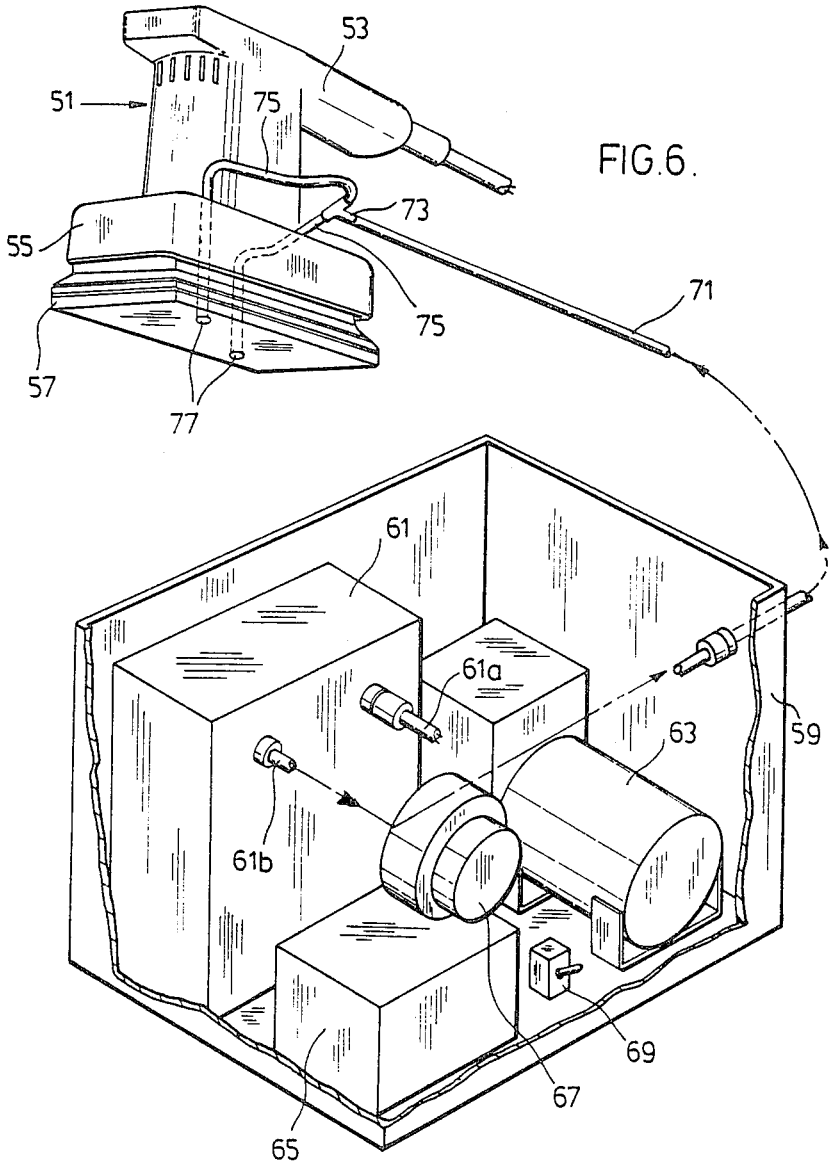
FIG. 6 is a perspective view showing an ozone furniture cleaning unit with its ozone producing unit shown in partial section according to a further preferred embodiment of the present invention.

FIG. 6 shows a further arrangement in which a cleaning unit generally indicated at 51 is hand held for use in cleaning furniture and the like. The cleaning unit itself includes a handle portion 53 having a base 55 supporting a cleaning head 57. The motor for the unit which is not shown in the figure is housed interiorly between the handle and the base support. The unit is set up such that when in operation cleaning head 57 which is in the form of a flexible pad vibrates for agitating the surface to be cleaned.

Ozone is fed to the cleaning unit from an ozone producing unit generally indicated at 59. This ozone producing unit comprises an electrical grid 61 similar to that described above with a small air compressor 63 which pressurizes the electrical grid 61 through its inlet 61A such that ozone is blown out through the outlet 61B of the grid arrangement. The grid itself is operated through a transformer 65 having a rheostat control 67 exposed outwardly of the ozone producing unit adjacent the on/off switch 69.

Outlet 61B from the grid arrangement is connected directly to a flexible tube 71 extending to the hand held cleaning unit where a small T-connector 73 connects the tube to a further pair of diverging tubes 75. Tubes 75 are fed through the base support 55 of the hand held cleaning unit so as to feed ozone outlets 77 extending directly through the cleaning head or pad 57.

As is the case with the earlier described embodiment the arrangement shown in FIG. 6 can be operated either with or without ozone. In either case the cleaning head is adapted to frictionally loosen dirt and dust from the furniture surface. When the ozone unit is in operation the ozone that is produced which is again prevented from escaping other than at the outlet tubes, is fed directly through the cleaning pad into the furniture where it is concentrated at the furniture surface through outlets 77. This particular unit may for example be set up to operate at about 0.5 cfm which again is safe to the health of the operator while at the same time providing more than enough ozone flow into the furniture surface to effect decontamination.

With the FIG. 6 arrangement the ozone producing unit is away from the cleaning unit to reduce its weight making the cleaning unit extremely light and easy to handle. If desired, a similar type of stationary ozone unit could be used with the cleaning unit of FIG. 1. Furthermore different types of ozone producing units from the electrical grid described above can be used in accordance with the present invention. Therefore although various preferred embodiments have been described herein in detail it will be appreciated by those skilled in the art that variations may be made without departing from the spirit of the invention or the scope of the appended claims.

The embodiments of the invention in which an exclusive property of privilege is claimed are defined as follows:

1. A system for ozone cleaning of surfaces on carpets, furniture, drapery and the like, said system comprising an ozone producing unit and a portable cleaning unit having a cleaning head, at least one ozone outlet at said cleaning head, an ozone passage from said ozone producing unit, a blower for blowing ozone along said ozone passage, said ozone producing unit being sealed to prevent escape of ozone therefrom other than from said ozone passage and said at least one ozone outlet directing the ozone under pressure from said blower past said cleaning head at the contaminated surface, and a shroud opening downwardly around said cleaning head and adapted to ride along the surface for maintaining a downward pressurized penetration of the ozone directly into the surface while substantially preventing escape of the ozone other than at the surface for maximizing the cleaning thereof.

2. A system as claimed in claim 1 wherein said ozone producing unit is mounted directly on said cleaning unit.

3. A system as claimed in claim 2 wherein said cleaning unit is adapted for cleaning floors and rugs with said shroud being secured to said cleaning unit by a flexible seal providing flotation of said shroud for automatic height adjustment of said shroud to the surface to be cleaned.

4. A system as claimed in claim 3 wherein said ozone passage comprises at least one tube from said ozone unit to said shroud, said at least one tube being flexible to move with the flotation of said shroud.

5. A system as claimed in claim 1 wherein said ozone producing unit is away from said cleaning unit with said cleaning unit being a hand held size for cleaning furniture and drapery and wherein said ozone passage comprises an elongated flexible tube from said ozone producing unit to said cleaning unit.

6. A system as claimed in claim 1 wherein said cleaning head is adapted to agitate the contaminated surface as the ozone is directed through the at least one ozone outlet.

7. A system as claimed in claim 6 including a shroud on said cleaning unit which completely surrounds and is of greater circumference than said cleaning head, said shroud being provided with a plurality of ozone outlets outwardly around said cleaning head for directing the ozone to the contaminated surface.

8. A system as claimed in claim 7 wherein said ozone passage comprises a plurality of tubes from said ozone unit to said outlets at said shroud, said outlets being spaced away from one another around said shroud.

9. A system as claimed in claims 1, 2 or 5 wherein said ozone producing unit comprises an electrical grid network adapted to provide a corona for producing ozone, said electrical grid network being provided with a control for controlling intensity of the corona to adjust the amount of ozone produced.

* * * * *